United States Patent [19]

Macemon

[11] 4,194,806

[45] Mar. 25, 1980

[54] CONNECTOR

[75] Inventor: Herbert J. Macemon, Versailles, Ky.

[73] Assignee: Kuhlman Corporation, Troy, Mich.

[21] Appl. No.: 640,011

[22] Filed: Dec. 12, 1975

[51] Int. Cl.[2] ..... H01R 11/08

[52] U.S. Cl. ..... 339/263 R; 85/61; 85/62; 151/22

[58] Field of Search ..... 339/263; 85/61, 62; 151/22

[56] References Cited

U.S. PATENT DOCUMENTS

| | | | |
|---|---|---|---|
| 806,156 | 12/1905 | Marshall | 151/22 |
| 1,531,049 | 3/1925 | Thompson | 339/263 |
| 2,405,402 | 8/1946 | Carter | 151/22 |
| 2,842,180 | 7/1958 | Brown et al. | 151/22 |

*Primary Examiner*—Joseph H. McGlynn

*Attorney, Agent, or Firm*—Everett R. Casey

[57] ABSTRACT

A connector such as for a manually installable fuse having a stud threadedly engageable with a nut, with mechanism for signalling the installer when the correct threaded engagement has been achieved and for establishing improved electrical conductivity at the connection upon that event.

4 Claims, 5 Drawing Figures

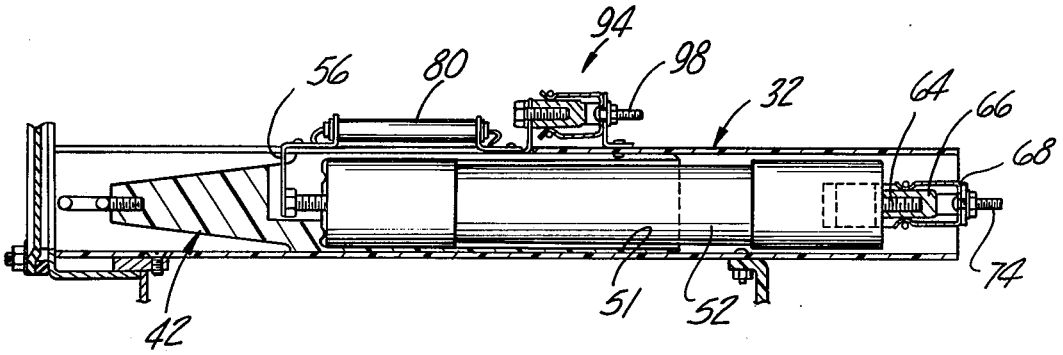
Fig-1
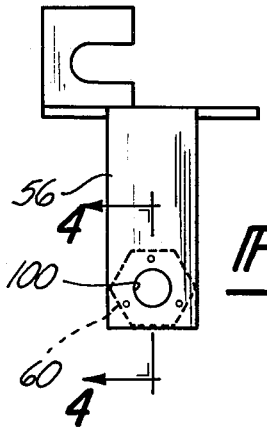
Fig-3
Fig-2
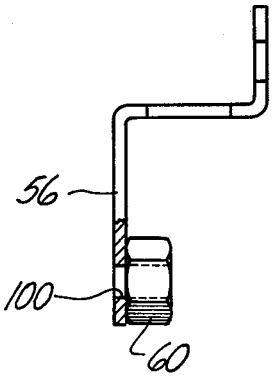
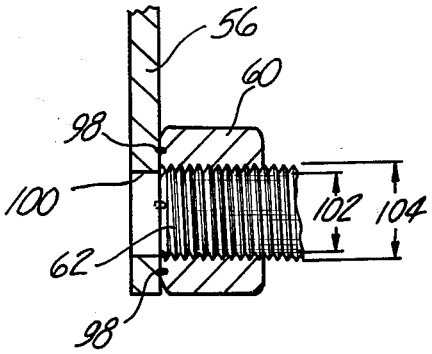
Fig-4
Fig-5
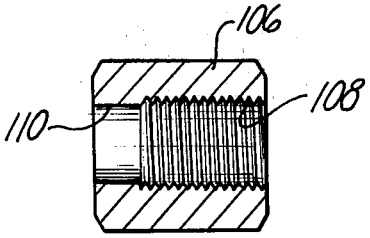

CONNECTOR

BRIEF SUMMARY OF THE INVENTION

This invention relates to an improvement upon a portion of the structure of U.S. Pat. No. 3,916,259 granted Oct. 28, 1975 to Russell and Mayer. That patent, the disclosure of which is incorporated herein by reference, relates to a fuseholder assembly for inserting fuses in a transformer. In the arrangement disclosed in the drawings of that patent, the threaded stud of an electrical fuse threadedly engaged a nut welded to a bracket to establish electrical and mechanical connection between the bracket and the use. It was intended that the fuse be manually rotated to threadedly engage the electrical-terminal stud thereof with the nut, with that rotation terminating no later than the point at which the end of the threaded stud abutted the face of the bracket to which the nut was projection welded. It has been discovered that the application of improperly excessive continuing torque, after that abutment occurred, put the projection welds into excessive tension and caused breakage of the weld. Since the body of the fuse could typically be in the order of $1\frac{5}{8}$ inches in diameter or so, a lineman, in replacing the fuse, could exert sufficient torque during hand insertion and tightening of the fuse to rupture the welds. The present invention resulted from efforts to create a solution to that problem.

THE DRAWINGS

FIG. 1 is a sectional view of a fuseholder assembly having a connector embodying the principles of the present invention;

FIG. 2 is an enlarged fragmentary side elevation of the connector assembly of FIG. 1;

FIG. 3 is a fragmentary front elevation of the assembly of FIG. 2;

FIG. 4 is a sectional view taken substantially along the line 4—4 of FIG. 3 with the fuse stud in place; and FIG. 5 is a cross sectional view of a contemplated alternative construction.

DETAILED DESCRIPTION

The structure of FIG. 1 (which is majorly the same as the structure disclosed in the above-identified patent) comprises a tube 32, mountable within a transformer, for accepting a fuse holder or fuse attachment device 42 which may be inserted therewithin from the exterior of the transformer. Fuseholder 42 is provided with a cavity 51 accepting a fuse 52 having threaded terminal or connector studs 62 and 64 extending from the respective ends thereof. As an illustrative example, fuse 52 might be, for example, a current limiting fuse such as Kearney type "A" series 1506, which is commercially available. Terminal 64 threadedly accepts a male contact 66 which is selectively insertable within a contact finger assembly 68 which is secured to the tube 32 and includes a screw 74 serving as a line terminal.

An end bracket 56 is secured to the fuseholder 42 and includes a portion projecting into an outer extension of cavity 51. Bracket 56 carries a nut 60 threadedly accepting terminal stud 62 of fuse 52, to thereby establish electrical connection between fuse 52 and bracket 56. It will be noted that a portion of bracket 56 is disposed within the cavity 51 and is spaced from the forward wall thereof. Bracket 56 is electrically connected to a fuse 80 (which may be a weak line fuse), the other terminal of which is electrically connected, through contact assembly 94, to an electrical terminal 98, whereby the serially interconnected fuses 52 and 80 may be connected, by terminals 74 and 98, in series in an electrical circuit, such as a transformer winding circuit.

For replacement, the fuseholder 42 may be withdrawn from the tube 32, separating the elements of the contact assembly 94 and separating contact 66 from the contact finger assembly 68 in the process. The fuse 52 is then manually unscrewed from the nut 60. A replacement fuse, provided with a contact 66, is then manually inserted in the cavity 51 (from the right in the view of FIG. 1) to bring its stud 62 into engagement with nut 60, and the fuse 52 is thereupon manually rotated to establish threaded engagement between elements 60 and 62. Proper relationship between stud 62 and nut 60 aids in establishing proper relationship between contact 66 and contact finger assembly 68, despite buildup of tolerances in the system.

As may best be seen in the enlarged views of FIGS. 2, 3 and 4, the nut 60 is suitably secured to the bracket 56 such as by projection welding at a plurality of points 98 (FIG. 4), nut 60 and bracket 56 constituting first and second portions of the female connector element. A bore or aperture 100 is drilled, punched or otherwise formed in the bracket 56 coaxially with the longitudinal centerline of the nut 60 and hence coaxially with the screw or stud to be inserted in that nut. Aperture 100, which is unthreaded, is of a diameter equal to or greater than the minor diameter 102 of the male member 62 but is smaller than the major diameter 104 of that thread.

Threading of the male member 62 in the nut 60 normally requires a very moderate amount of torque. However, when stud 62 has been rotated and hence advanced axially into engagement with bracket 56, further rotation of screw 62 tends to move that screw axially into hole or aperture 100. Since that hole is smaller than the major diameter 104 of screw 62, deformation must occur. In the preferred arrangement, portion 56 is harder and of lower ductility than the material of screw 62 as, for example, by forming screw 62 of a copper alloy, such as brass, and by forming plate or portion 56 of steel. The deformation, therefore, occurs substantially entirely in the threads of screw 62 in the preferred arrangement, the crests of the portion of the thread thereof entering aperture 100 being flattened or majorly eliminated depending upon the relative sizes of the parts.

Accordingly, the torque required to rotate the threaded stud 62 abruptly increases upon the engagement of screw 62 with portion 56 and continues at an increased (and normally somewhat increasing) value as an effort is made to continue to rotate screw 62 relative to nut 60 and relative to plate 56. This abrupt increase in torque serves as a signal to the lineman, or other person installing the fuse, that the fuse is essentially at its desired final location. It is preferred that the fuse be manually rotated through at least a small portion of a revolution after the higher resistance rotation is first met, such as, for example $\frac{1}{4}$ or $\frac{1}{2}$ of a turn, although the magnitude of the feasibly appropriate additional rotation will vary in accordance with factors including the effective lever arm of the fuse (which is related to the diameter of the body) and the relation of the size of bore or aperture 100 to the minor or root diameter 102 of the screw 62. The increase of torque requirement, resulting from deformation of the threaded stud and resulting in radial binding of the threads, occurs at a much greater rate than the increase in the tensile forces on the welds of the weld nut 60, so that substantially higher torques can be applied by providing the aperture 100, without failure of the welds 98, than would be the case if there were no aperture 100 in the plate 56.

It will be observed that when, during the course of the threaded engagement of male member 62 with nut 60, engagement occurs at aperture 100, the increased torque is also reflected in a force exerted parallel with the longitudinal axis of the screw 62 tending to force it to the right in the view of FIG. 4 relative to the female threads in nut 60. As a result, when screw 62 has been inserted so that at least a portion of its leading thread has been distorted in aperture 100, forces exist tending to force surfaces of the male thread 62 into tight engagement with surfaces of the female thread in nut 60 so as to create forceful area engagement between those threads and so as to thereby increase the electrical conductivity of the connection. The intimate engagement between the lead end of screw 62 and aperture 100 further contributes to the improvement of the electrical conductivity of the connector assembly.

Although thread deformation occurs at the end of the stud 62, unscrewing the stud, as for testing the fuse, causes the nut 60 to sufficiently reform the threads that reassembly of the same parts is possible. The initiation of counterclockwise rotation, to unscrew stud 62 from nut 60, requires nearly the same torque as was used in driving the stud initially, so that a significant locking action is achieved to prevent loss of the high conductivity characteristic of the conductor during, for example, shipment of the transformer.

It is intended that aperture 100 be made sufficiently large to insure that limited continued rotation of the stud 62 after engagement of the end thereof with bore or aperture 100 will not create sufficient forces to produce failure of the fuse (usually manifested as a breaking of the stud from the fuse body) or failure of the connector, usually maifested as a failure of the projection welds 98, that is, the magnitude or value of the increased torque to produce limited additional rotation after initial engagement of screw 62 with the edges of aperture 100 should be less than the torque which would produce failure of any of the parts. On the other hand, the aperture 100 should be made small enough to create the desired level of increased torque for the given application, so as to produce the desired signalling effect, locking action and improvement in electrical conductivity. It is preferred that in utilizing whatever lever arm to apply the torque as is reasonable and appropriate for the job (such as the illustrative manual tightening of a fuse, or the use of a specified wrench), the increased torque be of a level such that a workman would be capable of exerting the force to produce that torque, but would find it a significant burden to continue to do so beyond an additional turn or less. Thus, the intent is that once engagement is made, the workman should be feasibly able to produce some additional partial rotation to achieve the correct seating and relationship of the parts, but that such an effort be required that he is discouraged from continuing to rotate the screw after that point is reached. In the illustrated utilization of the concept, the diameter of aperture 100 should be equal to or larger than the root diameter 102 of the thread 62 but smaller than the major diameter thereof. Thus, as an example, in a constructed embodiment, using a $\frac{3}{8}$ stud with 16 threads per inch, and with the body of the fuse 52 having a diameter of about $1\frac{5}{8}$ inches and being rotated by hand without benefit of any wrench, the aperture 100 was selected to have a diameter of about 0.312 inches to cooperate with the thread having a major diameter of about 0.375 inches and a minor or root diameter of about 0.298 inches. Thus, in that constructed embodiment, the aperture diameter was but about 5% larger than the root diameter, and the aperture diameter was larger than the male thread root diameter by about 18% of the difference between the male thread root and major diameters. With those dimensions, it was found that whereas the weld nut on an arrangement having no aperture 100 would break, in tested samples (tested by driving a steel machine screw, with the same thread as the fuse stud, with a torque wrench), at about 140 inch-pounds torque, no failure of the projection welds occurred, with the noted sized aperture 100, when about 420 inch-pounds of torque was applied. In fact, with the noted tested arrangement, the torque limitation was shifted from failure of the projection welds to failure of the fuses themselves. Thus, in tested samples it was found that the stud-to-fuse connections (of the above-noted commercial fuses) tended to fail at about 150 inch-pounds of torque.

It will be appreciated that if the normally expected lever arm is smaller (such as when using a smaller diameter fuse), it may be advantageous to make hole 100 somewhat larger relative to the root diameter of the inserted male member (e.g., 25 or 50 percent of the difference between the male thread root and major diameters). If, on the other hand, in the given application, the increase in torque is not sufficient to discourage the workman from over inserting the male screw (as for example, where a specified-length wrench is normally used in the application), the diameter of aperture 100 may be reduced towards or to the root diameter 102 in order to achieve the desired level of torque.

In tests, conducted with the representatively described parameters, it was found that the torque required to manually rotate the $1\frac{5}{8}$ inch diameter fuse body upon initial partial-turn engagement with aperture 100 rose rapidly from a very low value (a few-inch pounds) to about 100 inch-pounds and then increased to about 150 inch-pounds in order to produce more than about one turn of additional insertion. It is believed that the latter FIGURE is higher than even the huskiest lineman would exert in field conditions. It is presently thought that a desirable torque level, giving a significant signal to the installer, is achieved in the noted utilization with about 50 to 130 inch-pounds of torque which, assuming a 0.8125 inch torque arm, is about 60 to about 160 pounds of force. Those FIGURES may desirably be higher or lower in other applications, depending on factors including the nature of the workmen and the failure torque of each element in the system.

It will be perceived that the establishment of the signal tends to lead the workman to position screw 62 at a relatively constant location relative to the plate 56, in which there is but a fractional insertion of the tip of the screw 62 therein, so that the thread engagement depth is reasonably constant on a series of installations, to aid in insuring proper positional relationship between equipment associated with stud 62 such as contact 66 and the spring contact assembly 68 (FIG. 1).

While the arrangement of FIG. 4 has the merit that it enables the use of relatively economic commercially available weld nuts 60 in conjunction with a simple stamped bracket 56, it is also contemplated that, if desired, those two portions of the female connector assembly can be made integral, as is illustrated in FIG. 5 in FIG. 5, the nut 106 has a threaded portion 108 for accepting a threaded stud, bolt or screw, that thread 108 extending but partially through nut 106, with a bore 110, coaxial with threads 108, extending through or partially through the remainder of the thickness of nut 106, with the diameter of bore 110 being selected in accordance with the considerations above discussed with reference to aperture 100. Nut 106 may, of course, be welded or otherwise secured to other elements of a contact or other assembly and is desirably made of a meterial harder and of lower ductility than the material of which the male threaded member is formed.

What is claimed is:

1. A connector comprising a unit having a threaded male member of a preselected hardness and ductility and having a male thread on a portion thereof, said male thread having preselected root and major diameters, a female member having a first internally threaded portion with a female thread accepting and mating with said male thread, and means effective upon the threading of said threaded male member through and beyond said first portion for producing an axial force tending to force surfaces of said male thread into forceable engagement with surfaces of said female thread and for limitedly increasing the torque required to further threadedly advance said male member through said first portion to a value greater than a first preselected value but less than a second larger preselected value comprising a second portion of said female member having a bore beyond and coaxial with said internally threaded portion and of a diameter at least as large as said preselected root diameter, and smaller than said major diameter, said second portion being of greater hardness and lesser ductility than said preselected hardness and ductility, said first internally threaded portion being a weld nut, said second portion being a support member for supporting said weld nut, said weld nut being welded to said support member.

2. The combination of claim 1 in which said second larger preselected value is one at which said weld fails.

3. A connector comprising a unit having a threaded male metallic current carrying member having a male thread on a portion thereof, said male thread having preselected root and major diameters, a female member having a metallic current carrying internally threaded first portion with a female thread accepting and mating with said male thread, and means effective upon the threading of said threaded male member through and beyond said first portion for producing an axial force tending to force the surfaces of said male thread into forceable engagement with surfaces of said female thread for increasing the electrical conductivity between said male and said female members and for increasing the torque required to further threadedly advance said male member through said first portion to a value effectively impeding such further threaded advance for signalling the establishment of a desired relationship between said members comprising a second portion of said female member having a bore beyond and coaxial with said internally threaded portion of a diameter at least as large as said preselected root diameter and smaller than said major diameter, said first portion being a weld nut, said second portion being a support member for supporting said weld nut, said weld nut being welded to said support member.

4. The combination of claim 3 in which said second larger preselected value is one at which said weld fails.

* * * * *